US007805767B2

(12) United States Patent
McElroy et al.

(10) Patent No.: US 7,805,767 B2
(45) Date of Patent: Oct. 5, 2010

(54) BODY ARMOR PLATE HAVING INTEGRATED ELECTRONICS MODULES

(75) Inventors: Michael McElroy, Gilbert, AZ (US); Eric Hoenes, Austin, TX (US); Louise Sengupta, Ellicott City, MD (US); Somnath Sengupta, Ellicott City, MD (US); Valent Horvatich, Scottsdale, AZ (US); Allister McNeish, Austin, TX (US); Joseph Wesley Coltman, III, Scottsdale, AZ (US)

(73) Assignee: BAE Systems Land & Armaments, Phoenix, AZ (US)

( * ) Notice: Subject to any disclaimer, the term of this patent is extended or adjusted under 35 U.S.C. 154(b) by 74 days.

(21) Appl. No.: 12/246,281

(22) Filed: Oct. 6, 2008

(65) Prior Publication Data

US 2010/0083428 A1 Apr. 8, 2010

(51) Int. Cl.

| | |
|---|---|
| ***F41H 5/00*** | (2006.01) |
| ***F41H 1/02*** | (2006.01) |
| *F41H 5/04* | (2006.01) |
| *F41H 5/02* | (2006.01) |

(52) U.S. Cl. ..... 2/2.5

(58) Field of Classification Search ..... 2/2.5
See application file for complete search history.

(56) References Cited

U.S. PATENT DOCUMENTS

| | | | | | |
|---|---|---|---|---|---|
| 3,331,083 | A | * | 7/1967 | Holly | 2/2.5 |
| 3,452,362 | A | * | 7/1969 | Korolick et al. | 2/2.5 |
| 3,557,384 | A | * | 1/1971 | Barron et al. | 2/2.5 |
| 3,559,210 | A | * | 2/1971 | Hansen | 2/2.5 |
| 3,793,648 | A | * | 2/1974 | Dorre et al. | 2/2.5 |
| 3,832,266 | A | * | 8/1974 | Archibald | 428/432 |
| 3,858,241 | A | * | 1/1975 | Durand et al. | 2/2.5 |
| 3,873,998 | A | * | 4/1975 | Norris et al. | 2/2.5 |
| 4,292,882 | A | * | 10/1981 | Clausen | 89/36.02 |
| 4,352,316 | A | | 10/1982 | Medlin | |
| 4,530,111 | A | * | 7/1985 | Barron et al. | 2/2.5 |
| 4,613,535 | A | * | 9/1986 | Harpell et al. | 428/113 |
| 4,633,756 | A | * | 1/1987 | Rudoi | 89/36.02 |
| 4,857,119 | A | | 8/1989 | Karst et al. | |
| 4,879,165 | A | * | 11/1989 | Smith | 428/212 |
| 4,923,728 | A | * | 5/1990 | Snedeker | 428/52 |
| 4,987,033 | A | * | 1/1991 | Abkowitz et al. | 428/469 |
| 5,007,326 | A | | 4/1991 | Gooch, Jr. et al. | |
| 5,060,314 | A | * | 10/1991 | Lewis | 2/2.5 |
| 5,185,195 | A | * | 2/1993 | Harpell et al. | 428/102 |
| 5,196,252 | A | * | 3/1993 | Harpell | 428/102 |
| 5,221,807 | A | | 6/1993 | Vives | |

(Continued)

*Primary Examiner*—Bobby H Muromoto, Jr.
(74) *Attorney, Agent, or Firm*—Pillsbury Winthrop Shaw Pittman LLP

(57) ABSTRACT

A body armor plate is configured to provide ballistics protection to a wearer of the plate. For example, the plate may be configured to protect the upper torso of the wearer from high-speed, ballistic projectiles like bullets, shrapnel, and/or other projectiles. In some implementations, the plate may include one or more electronic modules formed integrally therewith. Formation of the electronic modules integrally with the plate may enhance the functionality of the plate, may enhance the convenience (e.g., the form factor, the weight, the portability, etc.) of the electronics modules, robustness of the electronics modules, and/or other aspects of the electronics modules. The combination of the plate and the electronics modules may specifically provide various enhancements to, for example, military or law enforcement personnel that rely on the plate for ballistics protection.

18 Claims, 3 Drawing Sheets

U.S. PATENT DOCUMENTS 5,312,675 A * 5/1994 Cooper et al. ..... 428/215
5,340,633 A * 8/1994 van der Loo et al. ..... 428/114
5,349,893 A * 9/1994 Dunn ..... 89/36.05
5,362,527 A * 11/1994 Harpell et al. ..... 428/33
5,443,917 A * 8/1995 Tarry ..... 428/545
5,465,424 A 11/1995 Cudney et al.
5,500,952 A 3/1996 Keyes
5,515,541 A * 5/1996 Sacks et al. ..... 2/2.5
5,635,288 A * 6/1997 Park ..... 428/105
5,771,489 A * 6/1998 Snedeker ..... 2/2.5
5,824,940 A * 10/1998 Chediak et al. ..... 89/36.05
5,831,198 A 11/1998 Turley et al.
5,906,873 A * 5/1999 Kim ..... 428/57
5,935,678 A * 8/1999 Park ..... 428/105
5,960,470 A * 10/1999 Bachner, Jr. ..... 2/2.5
5,970,843 A * 10/1999 Strasser et al. ..... 89/36.02
6,000,055 A * 12/1999 Citterio ..... 2/2.5
6,009,789 A * 1/2000 Lyons ..... 89/36.02
6,026,510 A * 2/2000 Kocher ..... 2/2.5
6,029,269 A * 2/2000 El-Soudani ..... 2/2.5
6,035,438 A * 3/2000 Neal et al. ..... 2/2.5
6,131,193 A * 10/2000 Bachner, Jr. ..... 2/2.5
6,135,006 A * 10/2000 Strasser et al. ..... 89/36.05
6,138,275 A * 10/2000 Sacks ..... 2/2.5
6,154,880 A * 12/2000 Bachner, Jr. ..... 2/2.5
6,219,842 B1 * 4/2001 Bachner, Jr. ..... 2/2.5
6,314,858 B1 * 11/2001 Strasser et al. ..... 89/36.02
6,332,390 B1 * 12/2001 Lyons ..... 89/36.02
6,389,594 B1 * 5/2002 Yavin ..... 2/2.5
6,408,733 B1 * 6/2002 Perciballi ..... 89/36.02
6,500,507 B1 * 12/2002 Fisher ..... 428/36.1
6,510,777 B2 * 1/2003 Neal ..... 89/36.05
6,544,913 B2 * 4/2003 Kim et al. ..... 501/32
6,718,861 B1 * 4/2004 Anderson, Jr. et al. ..... 89/36.02
6,807,891 B2 * 10/2004 Fisher ..... 89/36.02
6,841,492 B2 * 1/2005 Bhatnagar et al. ..... 442/135
6,846,758 B2 * 1/2005 Bhatnagar et al. ..... 442/135
7,067,031 B2 * 6/2006 deWitt ..... 156/250
7,146,899 B2 12/2006 Imblum et al.
7,222,562 B2 5/2007 Smiley
7,404,352 B1 * 7/2008 Hoffman ..... 89/36.03
7,407,900 B2 * 8/2008 Cunningham ..... 442/135
7,540,228 B1 * 6/2009 Cronin et al. ..... 89/36.02
2002/0033744 A1 * 3/2002 Sengupta et al. ..... 333/157
2002/0034667 A1 * 3/2002 Sengupta ..... 428/702
2002/0093401 A1 * 7/2002 Chiu et al. ..... 333/231
2002/0093402 A1 * 7/2002 Sengupta et al. ..... 333/238
2002/0097117 A1 * 7/2002 Chiu et al. ..... 333/238
2002/0101309 A1 * 8/2002 Chiu et al. ..... 333/243
2002/0126048 A1 * 9/2002 Zhu et al. ..... 343/700 MS
2003/0119656 A1 * 6/2003 Chiu et al. ..... 501/138
2006/0252325 A1 * 11/2006 Matsumura et al. ..... 442/123
2007/0010151 A1 * 1/2007 Cunningham ..... 442/135
2007/0245441 A1 10/2007 Hunter
2007/0283477 A1 * 12/2007 Dovner ..... 2/2.5
2008/0155737 A1 * 7/2008 Marchesi ..... 2/456
2008/0307553 A1 * 12/2008 Jbeili et al. ..... 2/2.5

* cited by examiner

BODY ARMOR PLATE HAVING INTEGRATED ELECTRONICS MODULES

FIELD OF THE INVENTION

The invention relates to body armor having one or more electronics modules disposed therein.

BACKGROUND OF THE INVENTION

Body armor plates that provide protection against high-speed, ballistic projectiles are known. Generally, these plates do not provide any functionality beyond impact protection for the individual wearing them. While the protection that they provide tends to be superior to flexible, lighter materials, they increase the bulk and weight of the load of the wearer.

SUMMARY

One aspect of the invention relates to a body armor plate configured to provide ballistics protection to a wearer of the plate. For example, the plate may be configured to protect the upper torso of the wearer from high-speed, ballistic projectiles like bullets, shrapnel, and/or other projectiles. In some implementations, the plate may include one or more electronic modules formed integrally therewith. Formation of the electronic modules integrally with the plate may enhance the functionality of the plate, may enhance the convenience (e.g., the form factor, the weight, the portability, etc.) of the electronics modules, robustness of the electronics modules, and/or other aspects of the electronics modules. The combination of the plate and the electronics modules may specifically provide various enhancements to, for example, military or law enforcement personnel that rely on the plate for ballistics protection.

In some implementations, the plate may include a strike face, a backing surface, and a power charging and storage module. The strike face may be formed on an exterior of the plate, and may provide a surface on which ballistics projected at the wearer of the plate impact the plate. The backing surface may be provided on a side of the plate opposite the strike face such that the backing surface faces toward the wearer of the plate during use. The power charging and storage module may be disposed within the plate between the strike face and the backing surface, and may include a power source capable of providing power to electronic components.

The electronic components powered by the power source may include one or more electronic components disposed within the plate (e.g., between the strike plate and the backing surface). The electronic components powered by the power source may include one or more electronic components that are external to the plate. For example, the plate may include an external power interface that enables a hardwired connection between the power source within the plate and one or more electronic components external to the plate over which power can be delivered.

The power source of the power charging and storage module may include, for example, one or both of a super capacitor and/or a battery. The power source may be rechargeable. In some implementations, the power charging and storage module may be configured to recharge the power source wirelessly. Wireless charging of power sources may be relatively inefficient with respect to wired charging solutions. As such, wireless charging may enhance the functionality of the plate in certain implementations. For example, within the context of military or law enforcement use, wireless charging may provided benefits that outweigh the inefficiency of wireless charging. Since at times military or law enforcement personnel must quickly transition between down times and dealing with active threats, reducing the steps that must be taken to make this transition (e.g., unplugging the plate when it is being recharged) may enhance the safety of the wearer of the plate. By way of non-limiting example, wireless recharging of the power source of the power charging and storage module may facilitate power recharging during transport, meal times, downtime storage, and/or other instances of military or law enforcement use in which a threat may arise suddenly.

In some implementations, the plate may include a wireless transmission/reception module disposed between the strike face and the backing surface. The wireless transmission/reception module may be configured to transmit and receive information wirelessly to and from electronic components external to the plate. As such, the wireless transmission/reception module may include one or more antennae and one or more modulator/demodulators that cooperate to transmit and/or receive information wirelessly.

In some implementations, the plate may include an identification module disposed between the strike face and the backing surface. The identification module may be configured to identify the plate to an electronic component external to the plate by a wireless transmission of identification information. The identification module may identify the plate to the external electronic component by transmitting an identifier (e.g., via a wired external interface, via a wireless transmission/reception module within the plate, etc.) to the external electronic component. The transmission of the identifier may include further information related to the plate (e.g., geo-location information, power level information, etc.). The identifier may identify the wearer assigned to the plate. By way of non-limiting example, the identification module may form, in conjunction with a wireless transmission/reception module within the plate, an RFID device that transmits the identifier to an RF reader. In the context of military use, the identification of the plate and/or its wearer may facilitate the monitoring of troops, the monitoring of equipment, and/or other functionalities.

In some implementations, the plate may include one or more sensors. The sensors may include, for example, a geo-location sensor, an impact sensor, a power level sensor, and/or other sensors.

In some implementations, the plate may be deployed with the wearer by placing the plate into a pouch in a piece of protective apparel that holds the plate in place next to, for example, the upper torso of the wearer. The protective garment may itself include some sort of protection against ballistics that is significantly enhanced by the plate in the areas covered by the plate.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1:
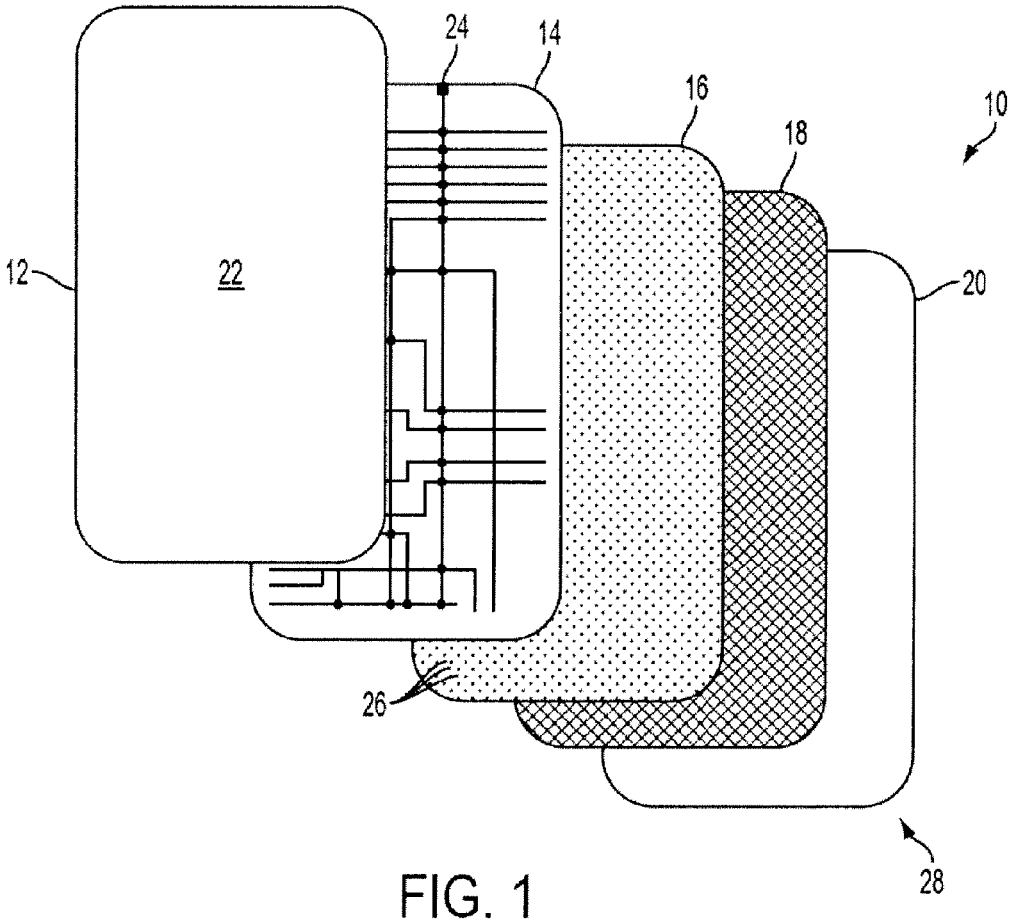
FIG. 1 illustrates an exploded view of a body armor plate, in accordance with one or more implementations of the invention.

FIG. 1 illustrates an exploded view of a plate 10 configured to provide ballistics protection to a wearer of plate 10, according to one or more implementations. For example, plate 10 may be configured to protect the upper torso of the wearer from high-speed, ballistic projectiles like bullets, shrapnel, and/or other projectiles. In some implementations, plate 10 may include one or more electronic modules formed integrally therewith. Formation of the electronic modules integrally with plate 10 may enhance the functionality of plate 10, and may provide various enhancements to, for example, military personnel that rely on plate 10 for ballistics protection. By way of non-limiting example, the electronic modules may include one or more of a power source, a module that wirelessly transmits and/or receives information, a module that provides information related to a geo-location of plate 10 and/or the wearer, a module that provides information related to impacts imparted on plate 10, a module that identifies plate 10 and/or the wearer to an external entity, and/or other modules.

In some implementations, plate 10 includes one or more of a cover layer 12, an electronics layer 14, a primary ballistics protection layer 16, a support layer 18, a backing layer 20, and/or other layers. It should be appreciated that the order in which layers 12, 14, 16, 18, and 20 are arranged in FIG. 1 is not intended to be limiting. Further, in some implementations, plate 10 may include more or fewer layers than those illustrated in FIG. 1. Although, layers 12, 14, 16, 18, and 20 are illustrated as being individual, separately formed members, in some implementations one or more of layers 12, 14, 16, 18, and/or 20 may be formed together with one or more of the other layers. Similarly, in some implementations, an individual one of layers 12, 14, 16, 18, and/or 20 may be made up of a plurality of sub-layers.

According to various implementations, cover layer 12 provides a strike face 22 of plate 10 on an external surface. Strike face 22 provides a surface on which ballistics projected at the wearer of plate 10 impact plate 10. Cover layer 12 may be formed from a material that is durable to the typical wear and tear experienced during use by the wearer. This wear and tear may include friction, collisions, and/or other forces experienced by plate 10 not including impacts from ballistic projectiles, in addition to the impacts from ballistic projectiles. Cover layer 12 may be formed from a material that reduces incidents of spalling caused by projectile impacts on plate 10. By way of non-limiting example, cover layer 12 may be formed from one or more of woven or non woven textile materials, polyurethane coatings, energy absorbing foams, and/or other materials.

In some implementations, electronics layer 14 is disposed between strike face 22 and backing layer 20. Electronics layer 14 may carry one or more electronics modules. The one or more electronics modules may include one or more electronic circuits that provide the functionality of the one or more electronic modules. The one or more electronic circuits may include one or more electrically conductive materials (e.g., semiconductor material of various kinds, gold, silver, copper, aluminum, tin, and zinc formed on a non-conductive substrate. The non-conductive substrate may be formed from one or more of flexible layers including polyimide, adhesive, and polyester, and/or other materials. Electronics module may include an external interface 24 that is accessible to the wearer when plate 10 is assembled. External interface 24 may provide a physical connection over which information and/or power may be communicated between one or more of the modules carried by electronics layer 14 and one or more components that are external to plate 10.

Primary ballistics protection layer 16 may provide the primary source of ballistic protection afforded the wearer of plate 10. As the primary source of protection from high-speed ballistics, primary ballistic protection layer 16 provides the main source of structural integrity in plate 10 that prevents such ballistics from penetrating plate 10. This does not mean that other components of plate 10 do not provide any protection from high-speed ballistics, or that other components do not play a roll in absorbing the energy imparted on plate 10 by high-speed ballistics. In some implementations, primary ballistics protection layer 16 may be formed from a ceramic such as, for example, alumina, boron carbide, titanium di-boride, silicon carbide, and/or other materials. As is shown in FIG. 1, primary ballistics protection layer 16 may be formed having a plurality of apertures 26 therein. Apertures 26 may be formed of a diameter significantly smaller than projectiles against which plate 10 provides protection (e.g., bullets). Apertures 26 may reduce the overall weight of primary ballistics protection layer 16. Since primary ballistics protection layer 16 may account for a relatively large amount of the overall weight of plate 10, the reduction in the weight of primary ballistics protection layer 16 accomplished via apertures 26 may substantially reduce the overall weight of plate 10.

Support layer 18 may be disposed between primary ballistics protection layer 16 and backing layer 20. Support layer 18 may be formed to absorb energy imparted to plate 10 generally, and to primary ballistics protection layer 16 in particular, by an impact of a projectile on strike face 22. In some implementations, support layer 18 may be ridged, as this structure may enable support layer to deform in response to an impact on strike face 22, thereby absorbing some of the energy from the impact in the deformation. Support layer 18 may be formed from one or more of fiber glass, carbon fiber, kevlar, and/or other materials.

Backing layer 20 may provide a backing surface 28 on a side of plate 10 opposite from strike face 22. During use, backing surface 28 may face toward the wearer. Backing layer 20 may be formed to provide durability through wear and tear, energy absorption, user comfort, ballistic protection from projectiles that pass through layers 16 and 18, and/or other functionality to plate 10. Backing layer 20 may be formed from one or more of polyurethane, polyethylene, ultra-high molecular weight polyethylene, aramid, rigid-rod polymer poly{diimidazo pyridinylene(dihydroxy)phenylene}, and/or other materials.

Figure 2:
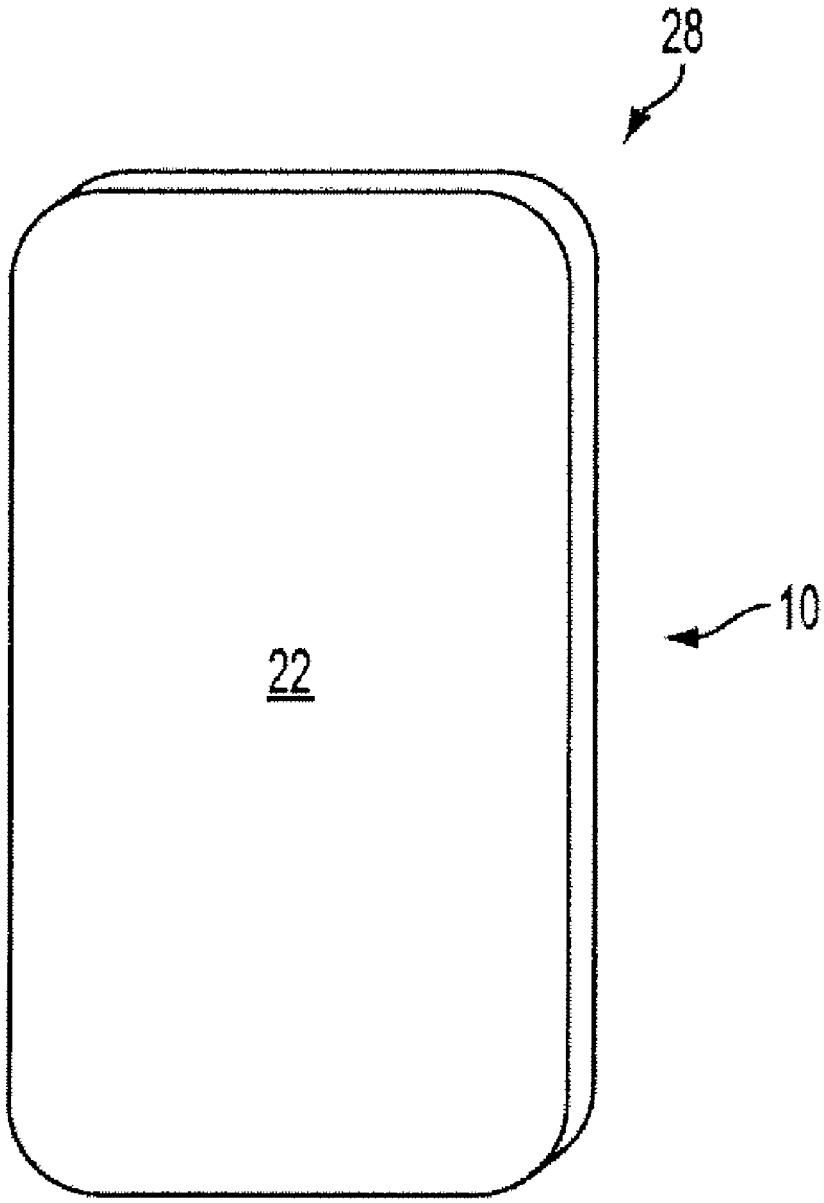
FIG. 2 illustrates a body armor plate, according to one or more implementations of the invention.

FIG. 2 illustrates plate 10 fully assembled, in accordance with one or more implementations. As can be seen in FIG. 2, plate 10, upon assembly, may form an integral unit that is typically not disassembled after manufacture. Plate 10 may be deployed with the wearer by placing plate 10 into a pouch in a piece of protective apparel that holds plate 10 in place next to, for example, the upper torso of the wearer. The protective garment may itself include some sort of protection against ballistics that is significantly enhanced by plate 10 in the areas covered by plate 10.

Figure 3:
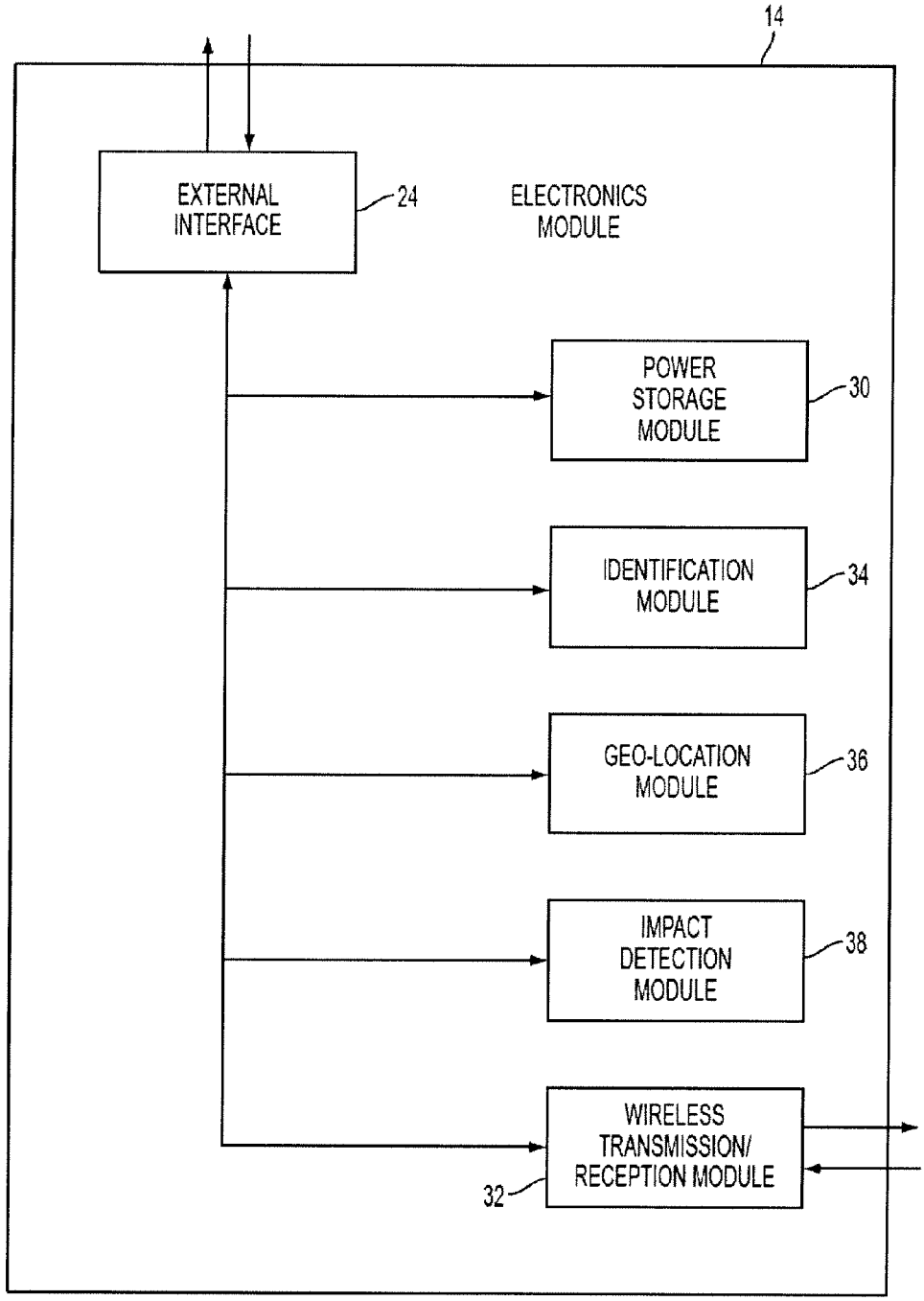
FIG. 3 illustrates a block diagram of an electronics layer disposed within a body armor plate, in accordance with one or more implementations of the invention.

As was mentioned above, electronics layer 14 may carry one or more electronic modules. FIG. 3 illustrates a block diagram of the electronic modules carried by electronics layer 14, in accordance with one or more implementations. In some implementations, the electronic modules carried by electronics layer 14 may include one or more of a power charging and storage module 30, a wireless power and data transmission/reception module 32, an identification module 34, a geo-location module 36, an impact detection module 38, and/or other modules. Modules 30, 32, 34, 36, and/or 38 may be embodied on electronics layer 14 in the actual circuitry carried by electronics layer 14 (e.g., as hardware), as software or firmware executed by processing circuitry carried by electronics layer 14, and/or as some combination of software, firmware, and/or hardware.

In some implementations, power charging and storage module 30 may include a power source capable of providing power to electronic components. The electronic components to which power charging and storage module 30 provides power may include one or more electronic modules within plate 10, and/or electronic components external to plate 10. Power may be delivered to electronic components external to plate 10 via, for example, external interface 24. The power source may include one or both of a battery and/or a super capacitor.

The power source of power charging and storage module 30 may be rechargeable. Power may be delivered to power charging and storage module 30 to charge the power source from an external power supply. The external power may be delivered via a wired connection (e.g., via external interface 24), the external power may be delivered wirelessly, and/or otherwise delivered. Wireless charging of power sources may be relatively inefficient with respect to wired charging solutions. As such, wireless charging may only enhance the functionality of plate 10 in certain implementations. For example, within the context of military use wireless charging may provided benefits that outweigh the inefficiency of wireless charging. Since at times military personnel must quickly transition between down times and dealing with active threats, reducing the steps that must be taken to make this transition (e.g., unplugging plate 10) may enhance the safety of the wearer of plate 10. By way of non-limiting example, wireless recharging of the power source of power charging and storage module 30 may facilitate power recharging during transport, meal times, downtime storage, and/or other instances of military use in which a threat may come up suddenly.

In some implementations, power charging and storage module 30 may include a power level sensor that detects a relative power level of the power source (relative to its maximum level). This information may be conveyed by power charging and storage module 30 to the wearer and/or other entities through wired communication (e.g., via external interface 24), through wireless communication (e.g., through module 32, discussed further below), and/or otherwise conveyed.

In some implementations, wireless transmission/reception module 32 may be configured to transmit and receive information wirelessly to and from electronic components carried by electronics layer 14. Wireless transmission/reception module 32 may transmit and receive information via one or more modulation schemes and/or at one or more frequencies. As such, wireless transmission/reception module 32 may include one or more antennae and one or more modulator/demodulators that cooperate to transmit and/or receive information wirelessly. The wireless transmission and/or reception of information by wireless transmission/reception module 32 may include one or more of short-range RF communications, IR communications, mid-range RF communications, long-range RF communications, satellite communications, microwave, millimeter wave, electromagnetic coupling, and/or other types of communications.

In some implementations, identification module 34 may be configured to identify plate 10 to an electronic component external to plate 10. Identification module 34 may identify plate 10 to the external electronic component by transmitting an identifier (e.g., via external interface 24, via wireless transmission/reception module 32, etc.) to the external electronic component. The transmission of the identifier may include further information related to plate 10 (e.g., geo-location information, power level information, etc.). The identifier may identify the wearer assigned to plate 10. By way of non-limiting example, identification module 34 may form, in conjunction with wireless transmission/reception module 32, an RFID device that transmits the identifier to an RF reader. In the context of military use, the identification of plate 10 and/or its wearer may facilitate the monitoring of troops, the monitoring of equipment, and/or other functionalities.

In some implementations, geo-location module 36 may be configured to determine information related to the geo-location of plate 10 and/or its wearer. For example, geo-location module 36 and wireless transmission/reception module 32 may form a Global Positioning Satellite ("GPS") sensor that receives communications from one or more satellites, and determines a geo-location of plate 10 from the received communications. In some instance, the information related to the geo-location of plate 10 determined by geo-location module 36 may be communicated to electronic components external to plate 10 (e.g., via external interface 24, via wireless transmission/reception module 32, etc.).

In some implementations, impact detection module 38 may detect impacts to plate 10. As such, impact detection module 38 may include an impact or force sensor that generates an output signal conveying information about impacts on strike face 24. In addition to impact detection armor integrity can be determined through the use of integrity sensors and sensing materials. The information generated by impact detection module 38 may be communicated to electronic components external to plate 10 (e.g., via external interface 24, via wireless transmission/reception module 32, etc.).

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A body armor plate configured to provide ballistics protection to a wearer of the plate, the plate comprising:

a strike face on an exterior of the plate that provides a surface on which ballistics projected at a wearer of the plate impact the plate;

a backing surface on a side of the plate opposite the strike face, wherein the backing surface faces toward the wearer of the plate during use;

a power source disposed within the plate between the strike face and the backing surface, the power source being configured to store power sufficient to power electronic components; and a power charging and storage module disposed within the plate between the strike face and the backing surface, the power charging and storage module being configured to distribute power from the power source electronic components.

2. The plate of claim 1, wherein the power source comprises one or both of a super capacitor and/or a battery.

3. The plate of claim 1, wherein the power source is rechargeable.

4. The plate of claim 3, wherein the power source is configured to be recharged wirelessly.

5. The plate of claim 1, further comprising an external power interface that enables electronic components external from the plate to be connected to the power charging and storage module to draw power therefrom.

6. The plate of claim 1, further comprising a wireless transmission/reception module disposed between the strike face and the backing surface, the wireless transmission/reception module being configured to transmit and receive information wirelessly to and from electronic components external to the plate.

7. The plate of claim 1, further comprising an identification module disposed between the strike face and the backing surface, the identification module being configured to identify the plate to an electronic component external to the plate by a wireless transmission of identification information.

8. The plate of claim 7, wherein the identification information identifies the wearer of the plate.

9. The plate of claim 1, further comprising one or more of a geo-location sensor, an impact sensor, or a power level sensor disposed between the strike face and the backing layer.

10. The plate of claim 1, further comprising a ceramic layer disposed between the strike face and the backing surface, wherein the ceramic layer provides the primary source of ballistic protection afforded the wearer by the plate.

11. A piece of protective apparel configured to provide ballistics protection to a wearer, the piece of protective apparel comprising:

an external surface on which ballistics projected at a wearer of the piece of body armor impact the piece of body armor;

a backing surface on a side of the body armor opposite the external surface such that the backing surface faces toward the wearer of the piece of body armor during use;

a rechargeable power source disposed within the piece of body armor between the external surface and the backing surface, the rechargeable power source being configured to store power sufficient to power electronic components; and a power charging and storage module disposed within the piece of body armor between the external surface and the backing surface, the power charging and storage module being configured to distribute power from the rechargeable power source to electronic components, and to recharge the rechargeable power source, wherein the power charging and storage module is further configured to receive power for recharging the rechargeable power source wirelessly.

12. The piece of protective apparel of claim 11, wherein the power source comprises one or both of a super capacitor and/or a battery.

13. The piece of protective apparel of claim 11, further comprising an external power interface that enables electronic components external from the piece of body armor to be connected to the power charging and storage module to draw power therefrom.

14. The piece of protective apparel of claim 11, further comprising a wireless transmission/reception module disposed between the external surface and the backing surface, the wireless transmission/reception module being configured to transmit and receive information wirelessly to and from electronic components external to the piece of body armor.

15. The piece of protective apparel of claim 11, further comprising an identification module disposed between the external surface and the backing surface, the identification module being configured to identify the plate to an electronic component external to the plate by a wireless transmission of identification information.

16. The piece of protective apparel of claim 15, wherein the identification information identifies the wearer of the plate.

17. The piece of protective apparel of claim 11, further comprising one or more of a geo-location sensor, an impact sensor, or a power level sensor disposed between the external surface and the backing surface.

18. The piece of protective apparel of claim 11, further comprising a ceramic layer disposed between the external surface and the backing surface, wherein the ceramic layer provides the primary source of ballistic protection afforded the wearer by the piece of body armor.

* * * * *